United States Patent [19]

Barclay

[11] 4,274,542

[45] Jun. 23, 1981

[54] METHOD FOR TRANSFER OF CRANE FROM TOWER

[75] Inventor: John H. Barclay, Radnor, Pa.

[73] Assignee: FMC Corporation, San Jose, Calif.

[21] Appl. No.: 15,273

[22] Filed: Feb. 26, 1979

[51] Int. Cl.[3] ..... B66C 11/02

[52] U.S. Cl. ..... 212/270; 212/176; 212/179

[58] Field of Search ..... 212/1, 46 R, 46 A, 46 B, 212/57, 64, 175–181, 270; 414/391, 399, 786; 29/426, 428, 429, 431

[56] References Cited

U.S. PATENT DOCUMENTS

| | | | |
|---|---|---|---|
| 2,676,388 | 4/1954 | Faure et al. | 212/64 X |
| 3,302,806 | 2/1967 | Brown et al. | 414/786 X |
| 3,624,784 | 11/1971 | Larson | 414/786 X |
| 3,672,115 | 7/1972 | Kerridge | 212/46 B |
| 3,894,635 | 7/1975 | Reich | 212/46 B |
| 3,982,634 | 9/1976 | Miyazaki | 212/1 |
| 4,028,792 | 6/1977 | Tax et al. | 29/431 |
| 4,064,615 | 12/1977 | Andersson | 212/46 R |

*Primary Examiner*—Robert G. Sheridan
*Attorney, Agent, or Firm*—A. J. Moore; R. B. Megley

[57] ABSTRACT

A method of transferring a crane from a tower to an adjacent elevated site, such as a building under construction. The crane is raised from the tower by an elevating frame secured at one end to the tower. A transition section is inserted between the crane and the top of the tower. A bogie with an open end on the site straddles the elevating frame and receives cross beams on each end. The crane and transition section are raised, and the bogie is centered with respect to the tower. The cross beams are positioned under the ends of the transition section to which they are then bolted. The elevating frame is lowered to transfer the full weight of the crane to the transition section, and to the bogie, which can then be moved horizontally on the site away from the tower.

12 Claims, 16 Drawing Figures

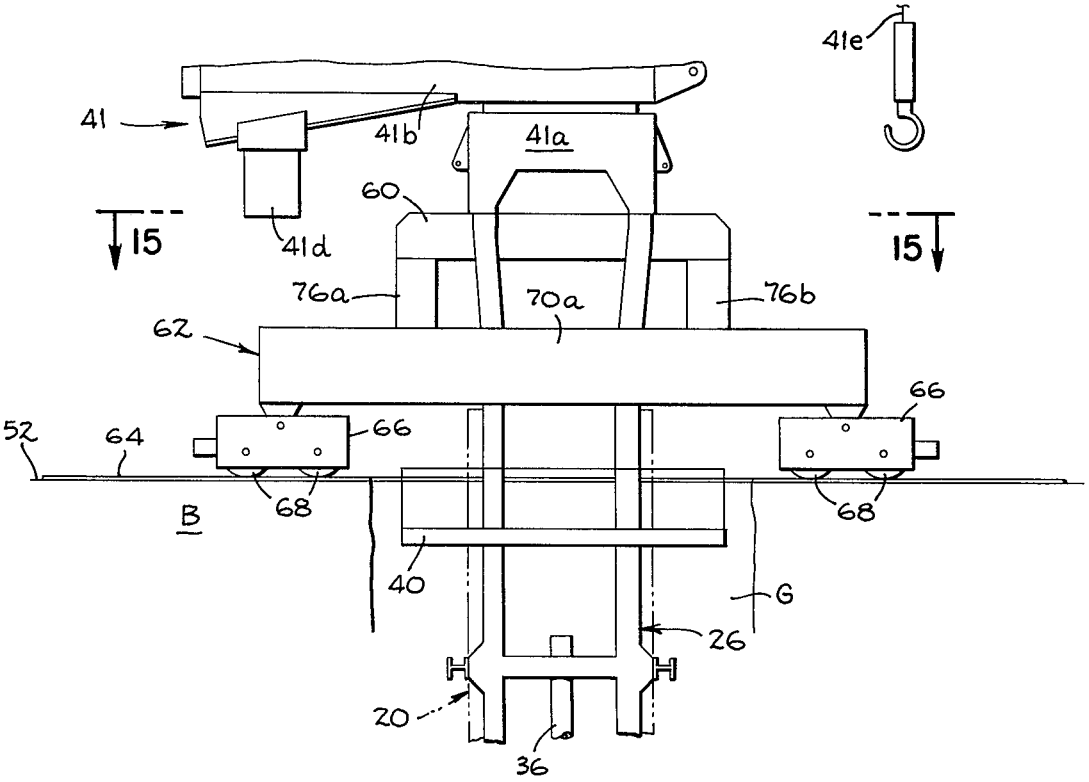
FIG_12
FIG_13
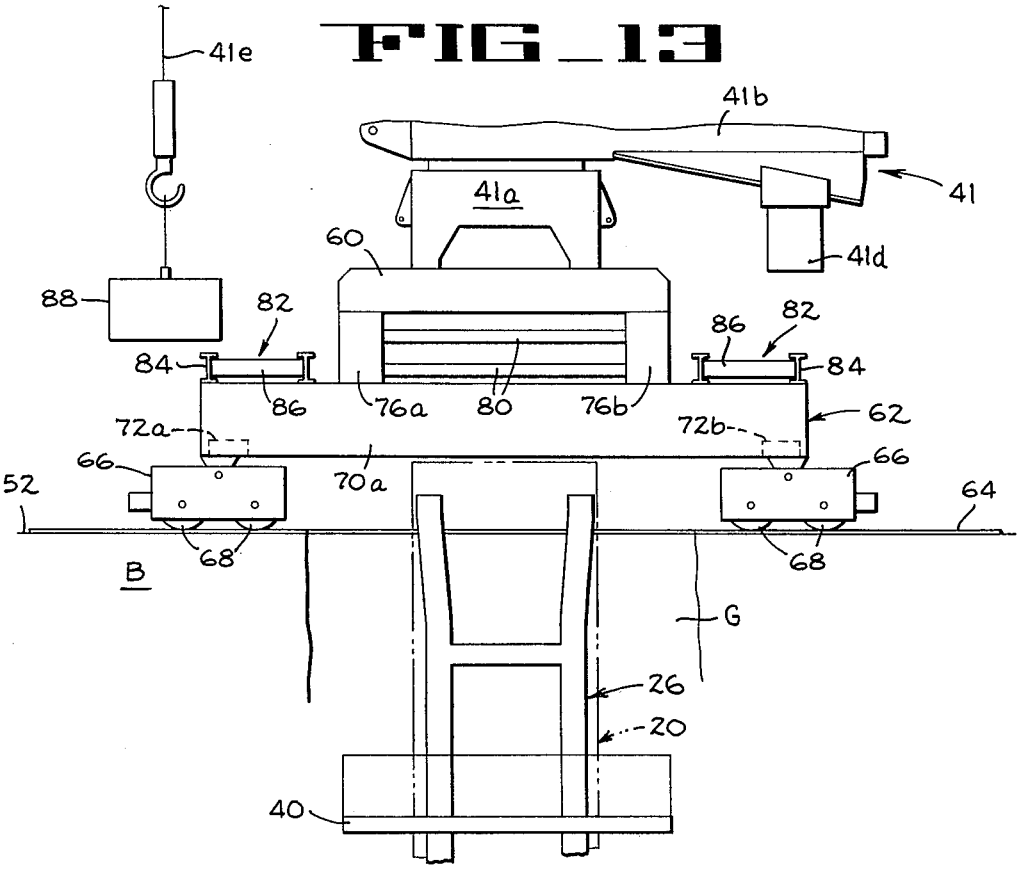

METHOD FOR TRANSFER OF CRANE FROM TOWER

BACKGROUND OF THE INVENTION

1. Field of the Invention

The present invention relates to cranes supported on a tower and, more specifically, to the transfer of the crane from the top of the tower to an adjacent site.

2. Description of the Prior Art

It is known to place a crane on a tower, the top of which is within the reach of a crane on the ground. This tower crane can then be utilized in the construction of a building, or other edifice, adjacent the tower. As the building grows higher, the crane can be used to add sections to the tower on which it is mounted. This has been done, for example, with an elevating, or climbing, mechanism or frame which has a base mounted at selected heights on the tower. The elevating frame has an upper portion which is connected to the crane, and has a ram which, when extended, raises the crane from the top of the tower. When so raised, the crane can lift an additional tower section from the ground and insert the section under the elevated crane. The new section is then connected to the previous upper section of the tower. The ram is then retracted to lower the crane onto the top of the newly added tower section.

SUMMARY OF THE INVENTION

The present invention is directed to the method of transferring a crane from a tower to a site adjacent the tower comprising the steps of elevating the crane above the top of the tower, assembling a structure on the site under the elevated crane, and lowering the crane onto said structure.

BRIEF DESCRIPTION OF THE DRAWINGS

FIG. 12 shows the connection of the cross beams to the transition section.

FIG. 13 shows the placement of ballast on each end of the bogie.

DESCRIPTION OF THE PREFERRED EMBODIMENTS

The present invention relates to a method for moving a crane 41 from the top of a tower 20 to an elevated site S which may, for example, be the top of a building under construction. Before describing the method of the present invention, it will be helpful to review the prior art structure and method by which a crane is raised to the top of the tower.

Figure 1:
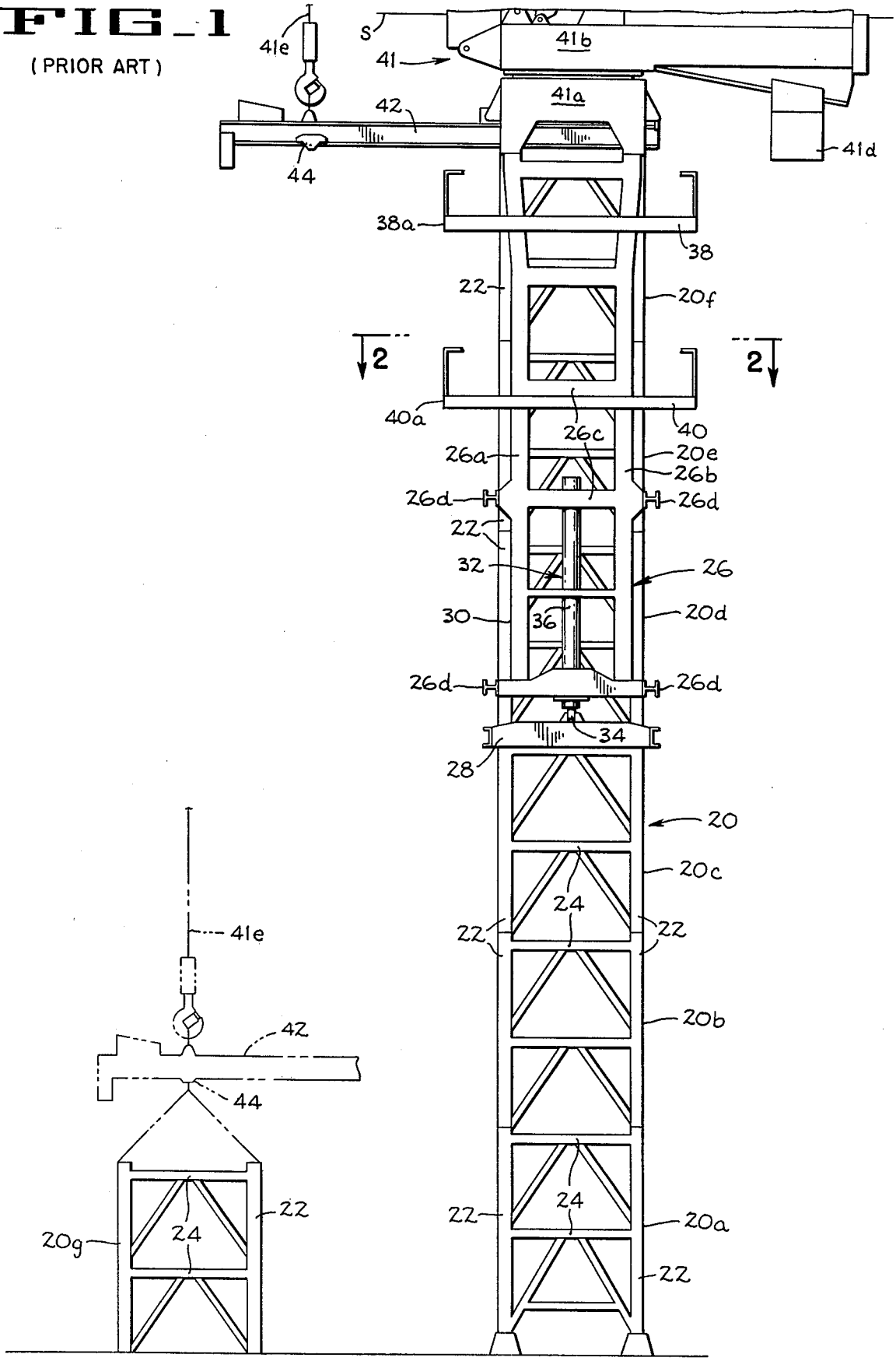
FIG 1 (PRIOR ART)
FIG. 1 is a side elevation of a tower having an elevating mechanism and having a crane perched on top of the tower.
Figure 2:
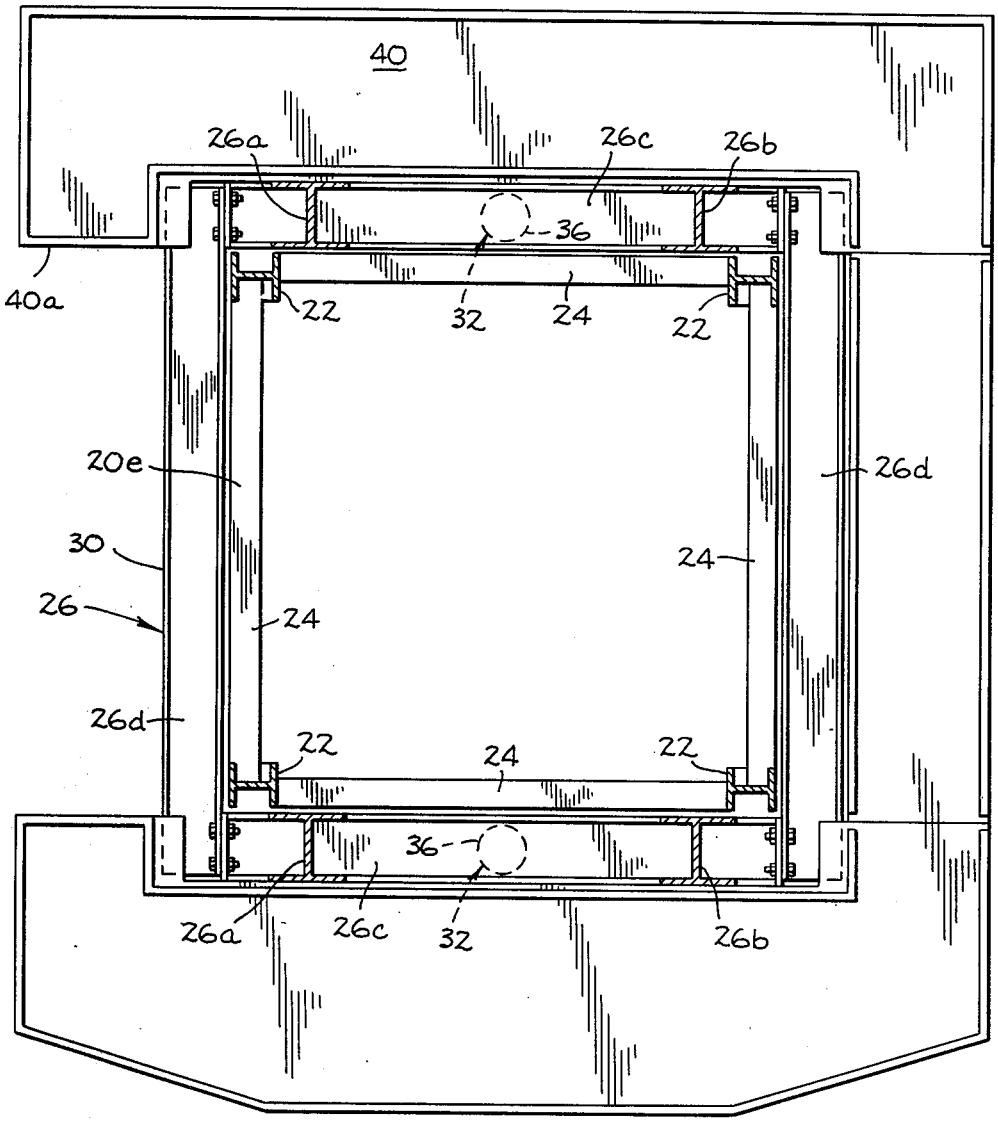
FIG 2 PRIOR ART
FIG. 2 is a view taken on the line 2—2 of FIG. 1.

A typical prior art tower 20 (FIG. 1) is made up of vertical tower sections **20*a*, 20*b*, 20*c*, 20*d*, 20*e* and 20*f*. Each tower section, which is rectangular in cross-section, has four corner beams 22 which are connected together by means of struts indicated generally at 24. The tower has an elevating, or climbing frame, mechanism 26, of rectangular cross-section, which has a base 28 and a movable support member 30. As shown in FIGS. 1 and 2, a ram 32 on each side of the climbing frame mechanism has a rod 34 extending from one end which is connected to base 28, and has a hydraulic cylinder 36 which is connected to the movable support member 30. The climbing frame has an upper platform 38 and a lower platform 40, as shown in FIGS. 1 and 2. The climbing frame, which on each side has vertical beams 26*a*, 26*b*, and cross members 26*c*, has tie beams 26*d* connecting the two sides. Thus, the climbing frame surrounds the tower 20, as shown best in FIG. 2. The upper and lower platforms 38 and 40 have openings 38*a* and 40*a* on one side as shown in FIGS. 1 and 2**.

When the base member 28 of the climbing frame is secured to the tower, and the ram is extended or retracted, the movable support member is raised or lowered, respectively, for a purpose to be described.

The initial vertical sections of the tower are assembled, one on top of the other, by a crane (not shown) on the ground adjacent the tower. While the top of the tower 20 is still within the reach of the ground crane, the climbing frame 26 is mounted on the tower with the base 28 secured to the tower at a height where the top member 30 of the climbing frame will extend above the top of the tower with the ram 32 in its retracted position. After the climbing frame is in place, the crane 41, which is to be positioned at the top of the tower during construction of the building, is hoisted by the ground crane (not shown) to the top of the climbing frame and secured thereto. The crane 41 has a base **41*a*, an upper works 41*b* rotatably mounted on the base 41*a*, a boom 41*c* (FIG. 3) pivotally mounted on the upper works 41*b*, and a shiftable counterweight 41*d*** for balance of the crane.

Thereafter, additional tower sections (such as **20*g*, FIG. 1) can be installed on top of the tower by the following procedure. A support beam 42 having a carriage 44 mounted thereon is lowered to the ground by the crane, the tower section 20*g* is attached to the carriage by workers on the ground and raised to position in the crane base. The ram 32 of the climbing frame 26 is extended to lift the crane 41** so that a gap is present between the top of the tower and the base of the crane.

The carriage 44 moves inwardly on the beam 42 through the openings 38*a* and 40*a* in the platforms 38 and 40 (over tie beams 26*d*) for connection of the tower section 20*g* to the top of the tower by workmen on the lower platform 40. The crane 41 is lowered by the climbing frame 26, and the base 41*a* of the crane is then connected to the upper end of the new section 20*g*. The base 28 of the climbing frame is disconnected from the tower and moved upwardly by retracting the ram. The climbing frame base 28 is then reconnected to the tower in preparation for the erection of an additional section on the tower.

When the tower is erected to its full height, which is a predetermined distance above the height of the site onto which the crane is to be moved, the procedure of the present invention is undertaken to remove the crane 41 from the tower 20 to the building site.

Installation of Transition Section

Figure 3:
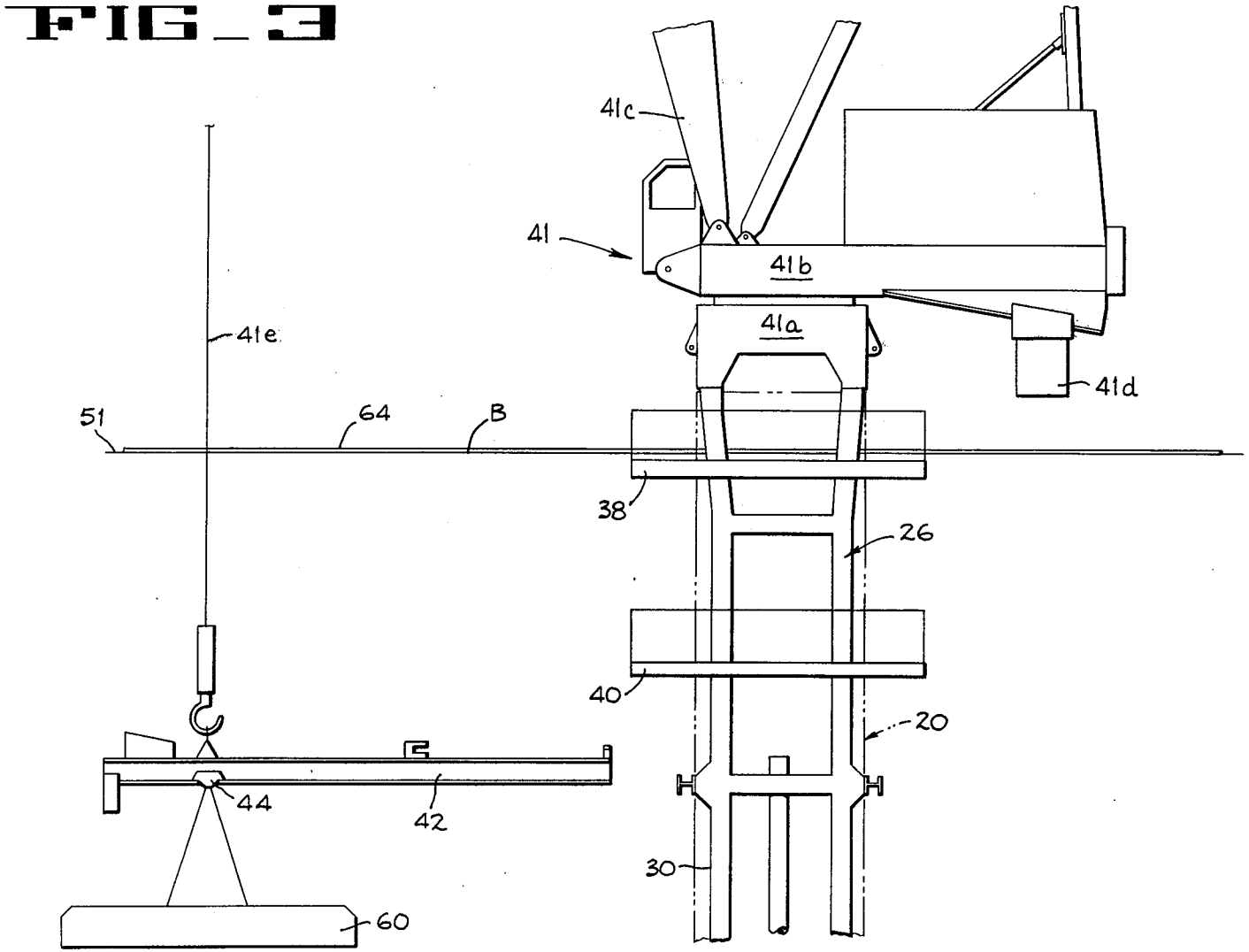
FIG. 3 is a side elevation, in somewhat schematic form, showing the crane raising the transition section.
Figure 15:
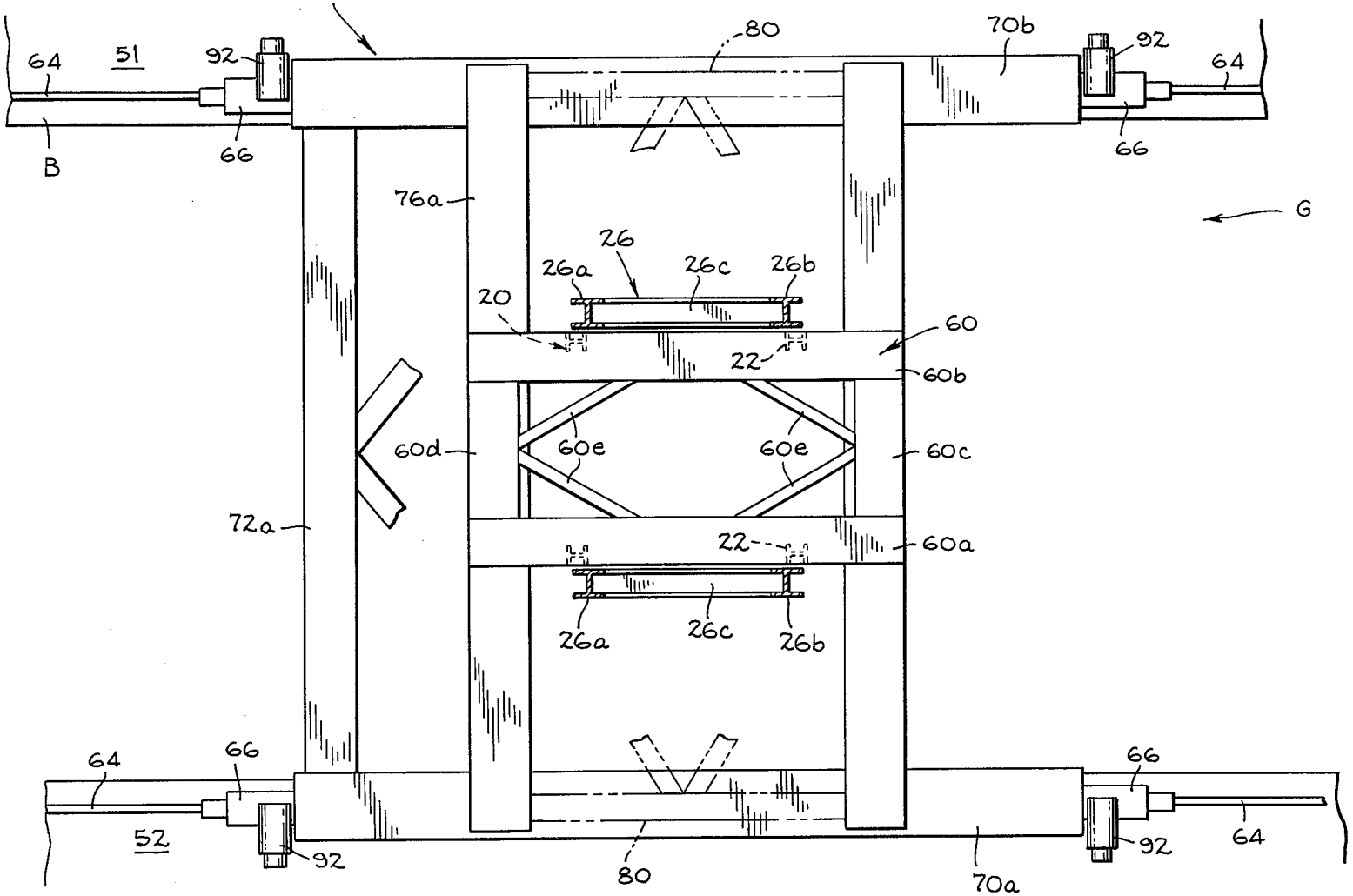
FIG. 15 is a view taken on the line 15—15 of FIG. 12.

With the base 41*a* of the crane at the top of the tower 20 and secured to the upper end of the climbing frame 26, the crane load line 41*e*, which is trained over the end of the boom 41*c*, is lowered to the ground with the support beam 42 carried thereby. Workmen on the ground connect a transition section 60 to the carriage, and the load line is raised by the crane, as shown in FIG. 3. The transition section 60, as shown in FIG. 15, is made up of side beams 60*a*, 60*b*, and end beams 60*c* and 60*d* which are connected together to form a rectangular frame. Internal struts, shown generally at 60*e*, are connected in the form of a diamond for strengthening the transition section. The transition section is of the width to fit between the vertical beams of the respective sides of the climbing frame 26 to rest on the top of the upper section of the tower 20.

Figure 4:
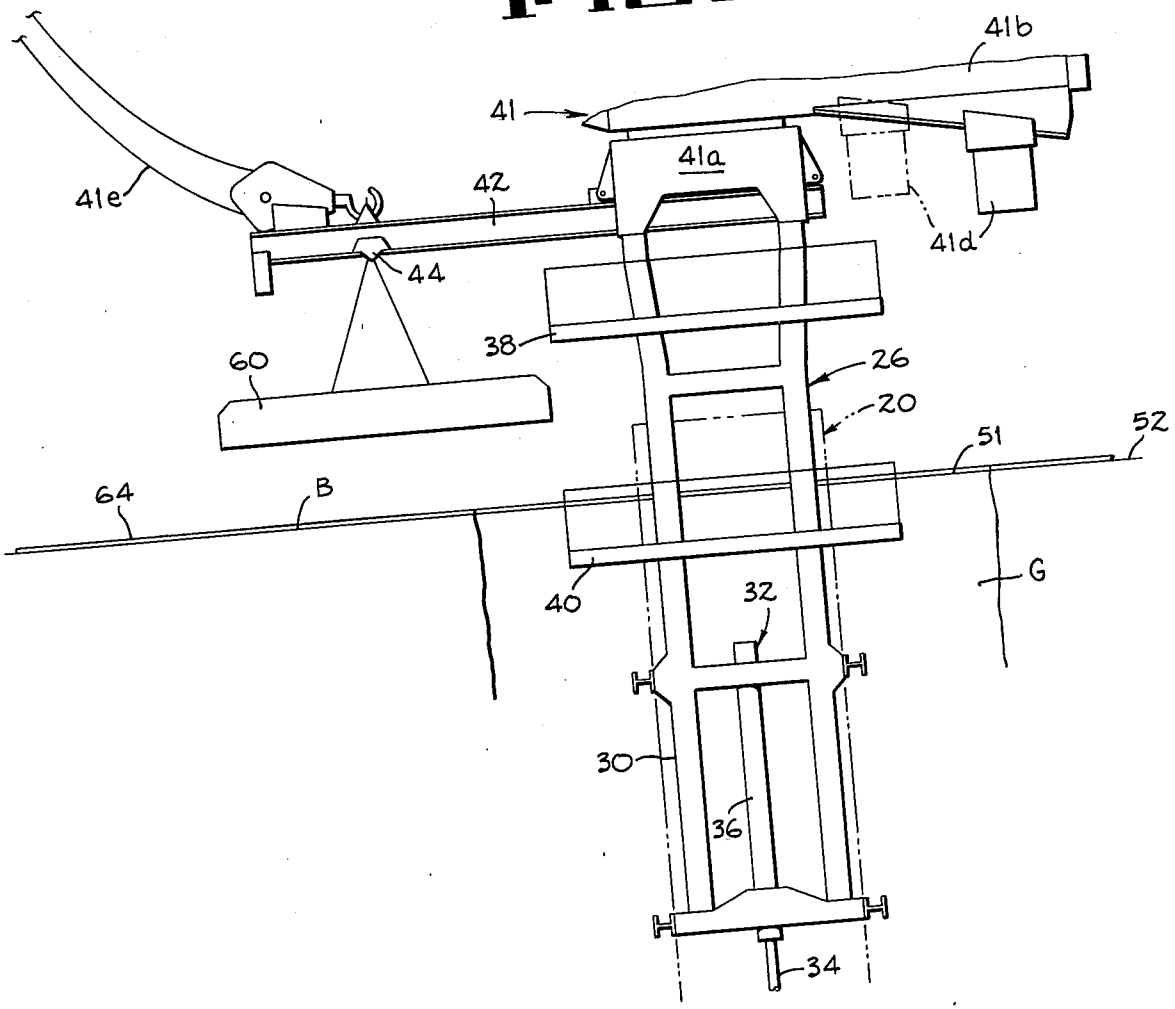
FIG. 4 shows the elevation of the crane to receive the transition section.
Figure 5:
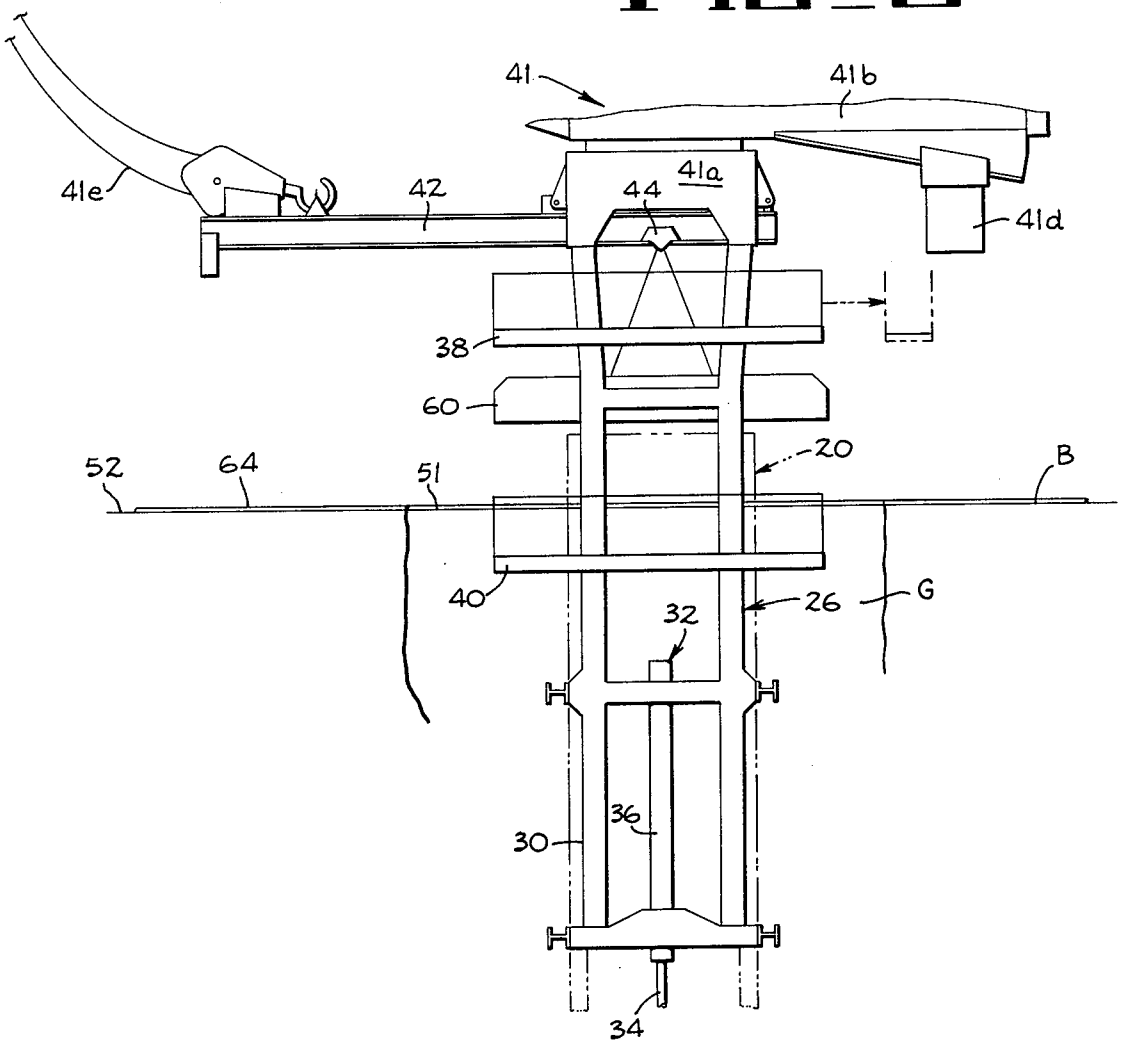
FIG. 5 shows the insertion of the transition section between the base of the crane and the top of the tower.
Figure 6:
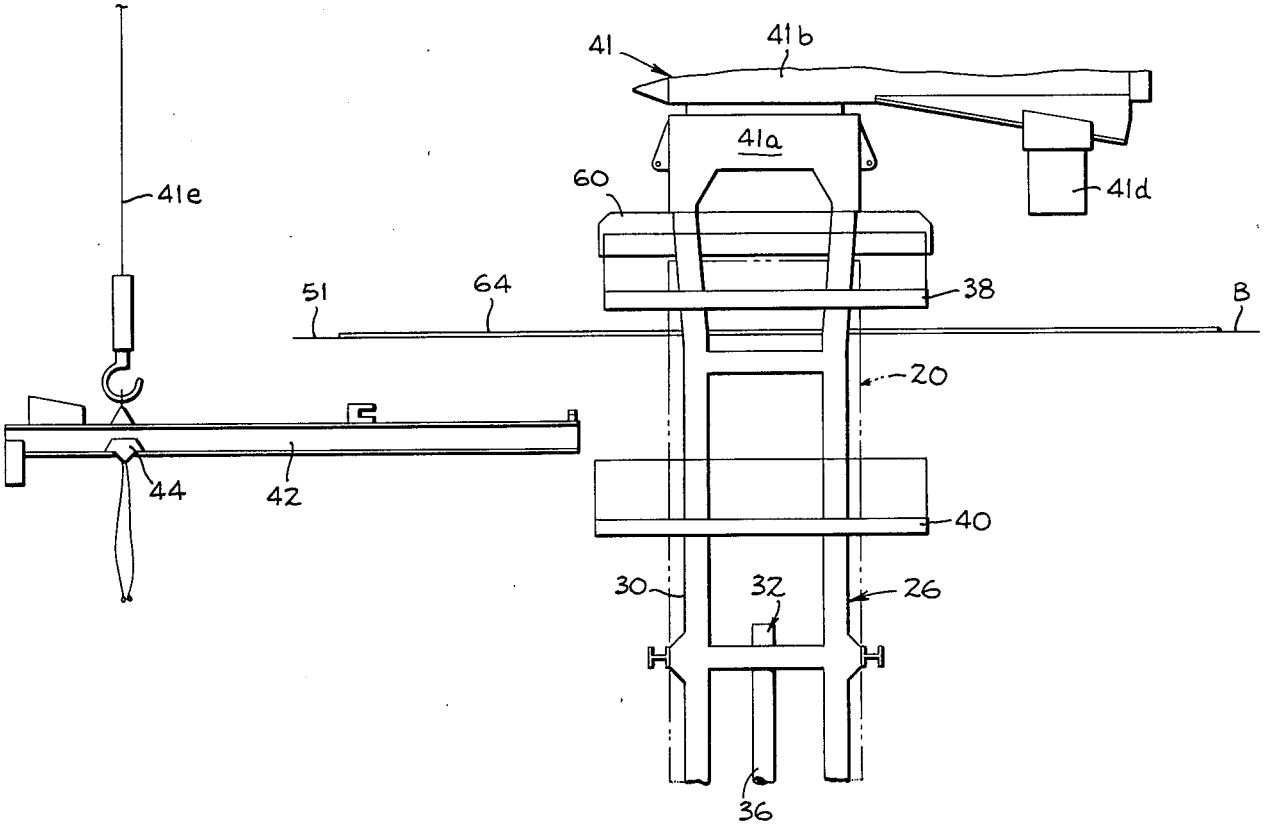
FIG. 6 shows the lowering of the crane onto the transition section.

The beam 42 is inserted into the base of the crane as shown in FIG. 4 and bolted therein. The crane 41 is elevated above the tower 20 by the climbing frame 26 a sufficient distance for the transition section 60 to be moved by the carriage 44 inside the vertical beams of the climbing frame and over the top of the top tower section. At this time, the rear section of the upper platform 38 is removed as shown in FIG. 5. The crane 41 is then lowered by the climbing frame 26, and the base 41*a* of the crane is bolted to the transition frame 60 (FIG. 6) which is, in turn, bolted to the top of the upper section on the tower 20. The support beam is unpinned, removed from the base section of the crane, and lowered to the ground.

Raising and Partial Assembly of Bogie

Figure 7:
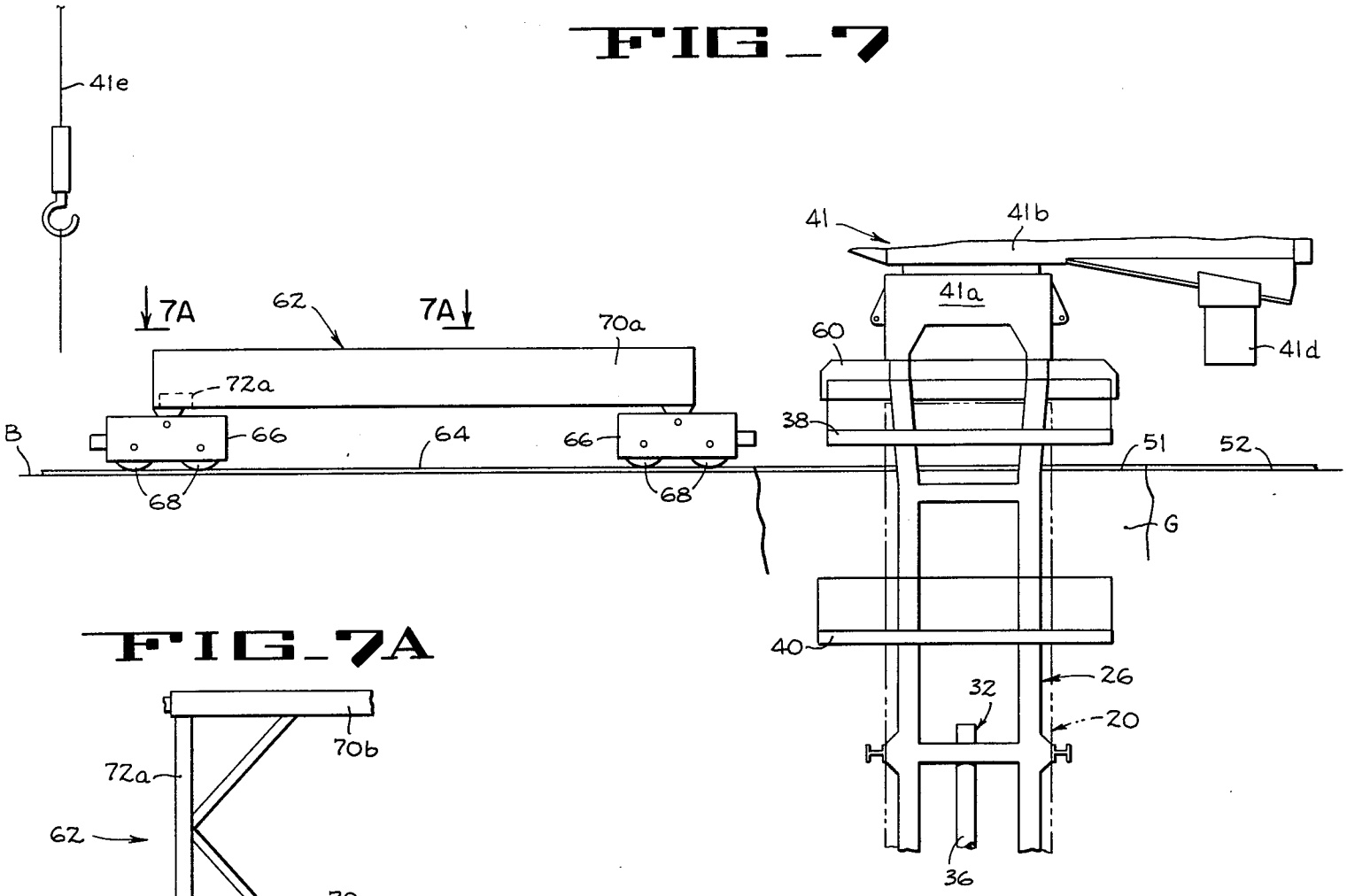
FIG. 7 shows the bogie on the site adjacent the tower.

The method of the present invention uses a bogie 62 (FIG. 7) to which the crane is transferred. This bogie, which is mounted on rails 64 on the site, becomes the mobile underworks of the crane for movement of the crane on the site after the transfer of the crane. The parts for the bogie may be raised to the site by the crane before the transition section is inserted between the crane and the top of the tower. Indeed, the bogie can be raised to the site by other means, not shown (such as the use of winches or the like). However, I prefer to raise the bogie in the manner hereinafter described after the transition section has been inserted between the top of the tower and the base of the crane.

In the illustrated embodiment of the invention, the building B (the top floor of which defines the site to which the crane is to be transferred) has an elongated gap G through which the tower extends, as shown in FIG. 15. The rails 64 rest on horizontal surfaces S1 and S2 of the building on each side of the gap G.

Figure 7A:
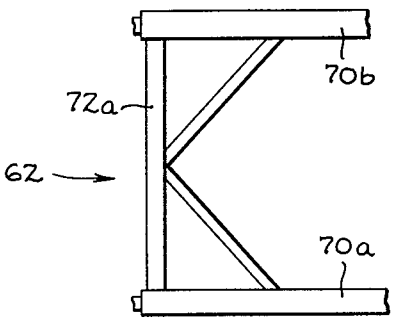
FIG. 7A is a view taken on the line 7A—7A of FIG. 7.

The rails 64 on top of the building straddle the tower, the upper end of which extends through the floor, or surfaces 51, 52 on which the rails are laid, and extends above the level of the rails a predetermined distance. A pair of trucks 66 (see FIG. 7), each having two wheels 68 in tandem array, are assembled to the respective ends of the side beams 70*a*, 70*b* of the bogie, or carriage 62, by workmen on the ground. The load line 41*e* (with the support beam 42) brings up each side, one at a time, of the bogie 62 and deposits them respectively on the rails which straddle the tower. The bogies are temporarily supported on the rails until a cross brace 72*a* can be installed by workmen on the site, as shown in FIG. 7A. After a cross brace 72*a* is connected to the side beams at the end remote from the tower, the bogie defines a U-shaped structure which is open at the end closest to the tower.

Completion of the Bogie on the Site by the Crane

Figure 8:
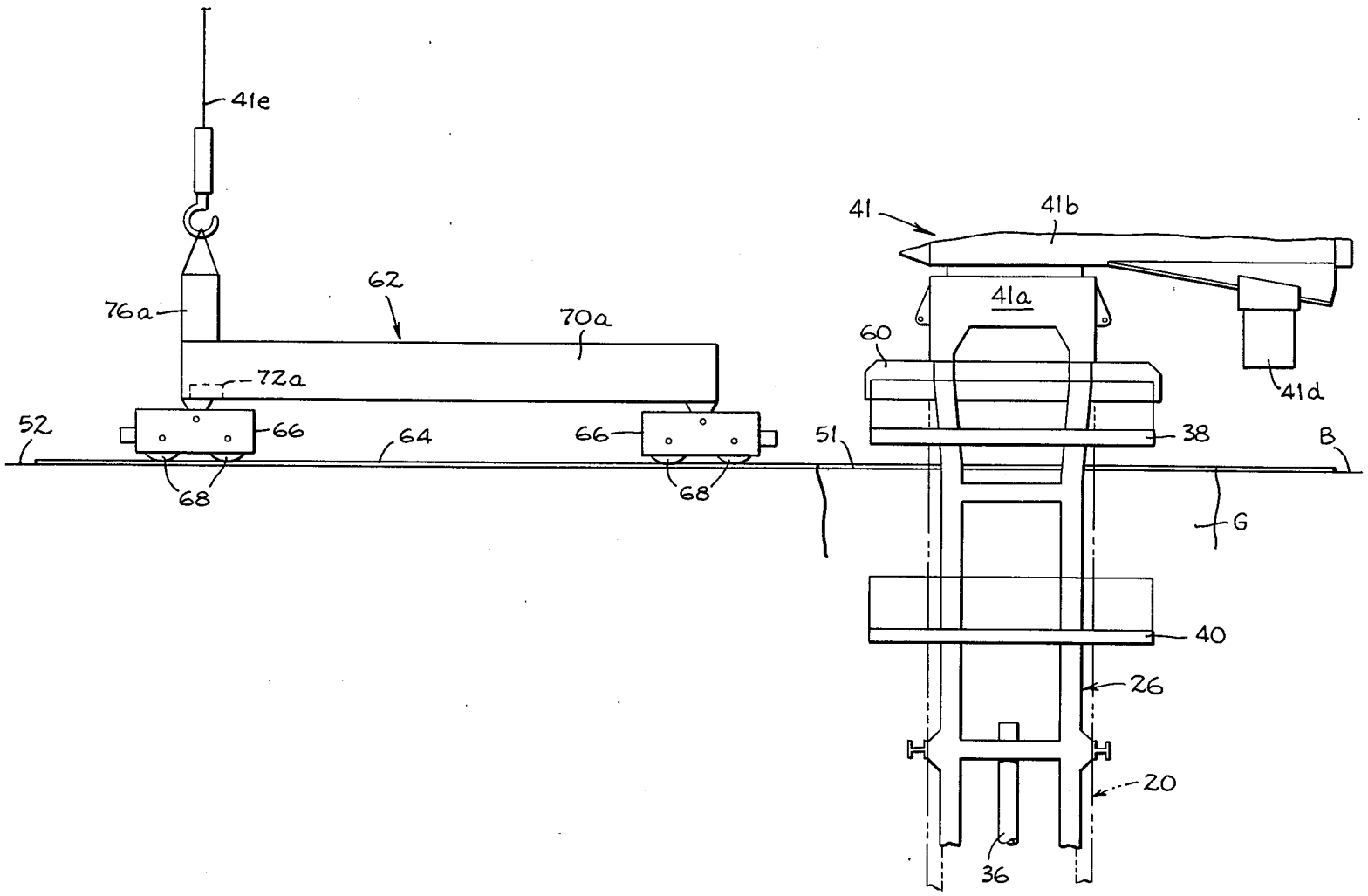
FIG. 8 shows the placement of a cross beam at one end of the bogie by the crane.

A cross beam 76*a* is raised by the crane to extend across the side beams 70*a*, 70*b* of the bogie at the end remote from the crane 41 and over the cross brace 72*a*, as shown in FIG. 8. The upper climbing frame platform 38 is removed and replaced with a temporary platform (not shown).

Figure 9:
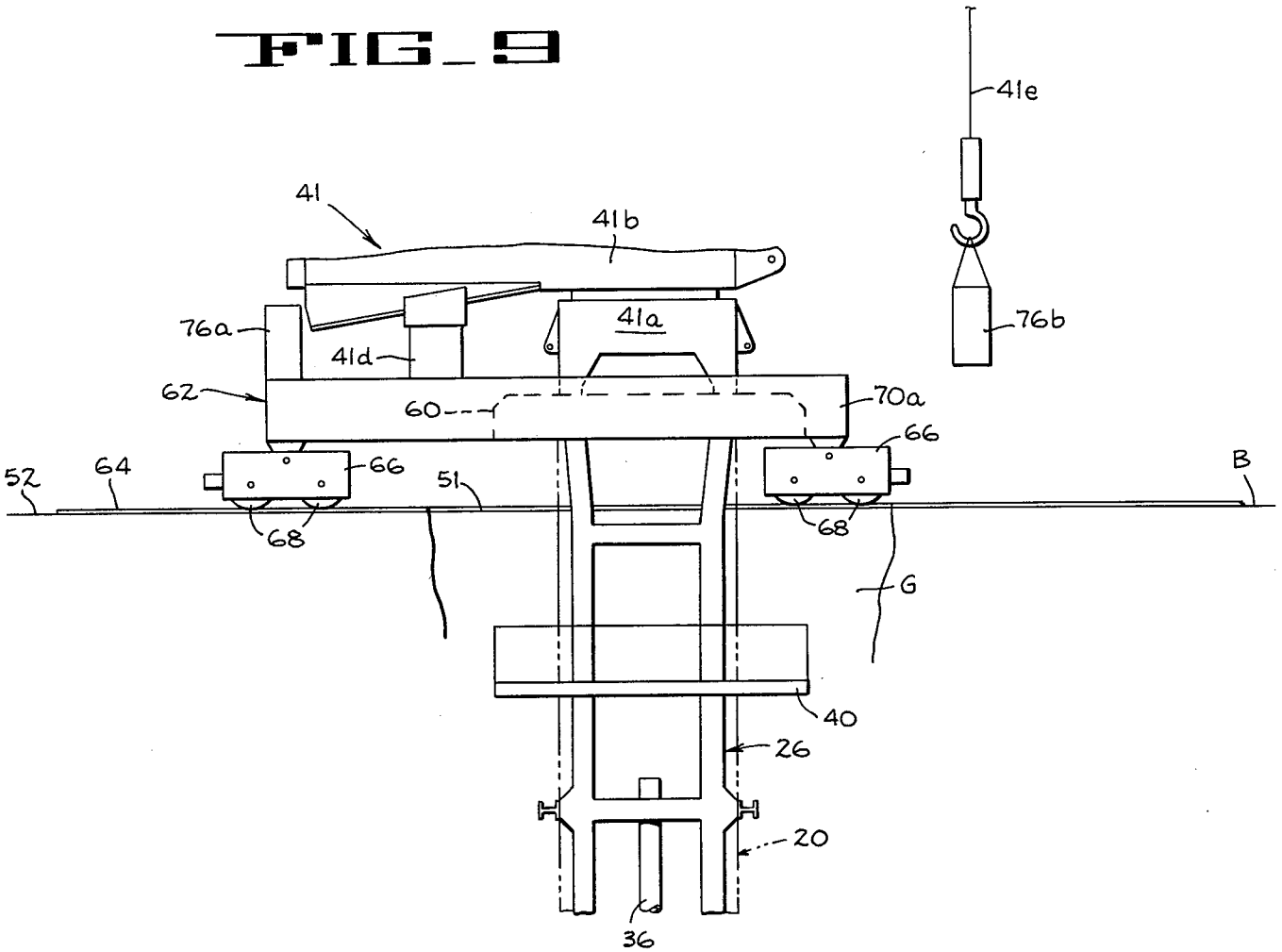
FIG. 9 shows the bogie embracing the elevating frame and the placement of another cross beam on the other end of the bogie after rotation of the crane.

The upper works of the crane is rotated 180° on the crane base, as shown in FIG. 9, and the U-shaped bogie 62 is rolled along the rails to embrace the climbing frame 26. The bogie is moved until the cross beam 76*a* is adjacent the rear end of the upper works 41*b* of the crane.

The crane then picks up another cross beam 76*b* which is placed across the side beams 70*a*, 70*b* of the bogie 62 at the end opposite the cross beam 76*a*. Thus, at this time, the bogie, with the two cross beams at the extreme ends, completely surrounds the climbing frame 26 of the tower, and the transition section 60 which is connected between the top of the tower and the base of the crane.

Positioning of Cross Beams on the Bogie

Figure 10:
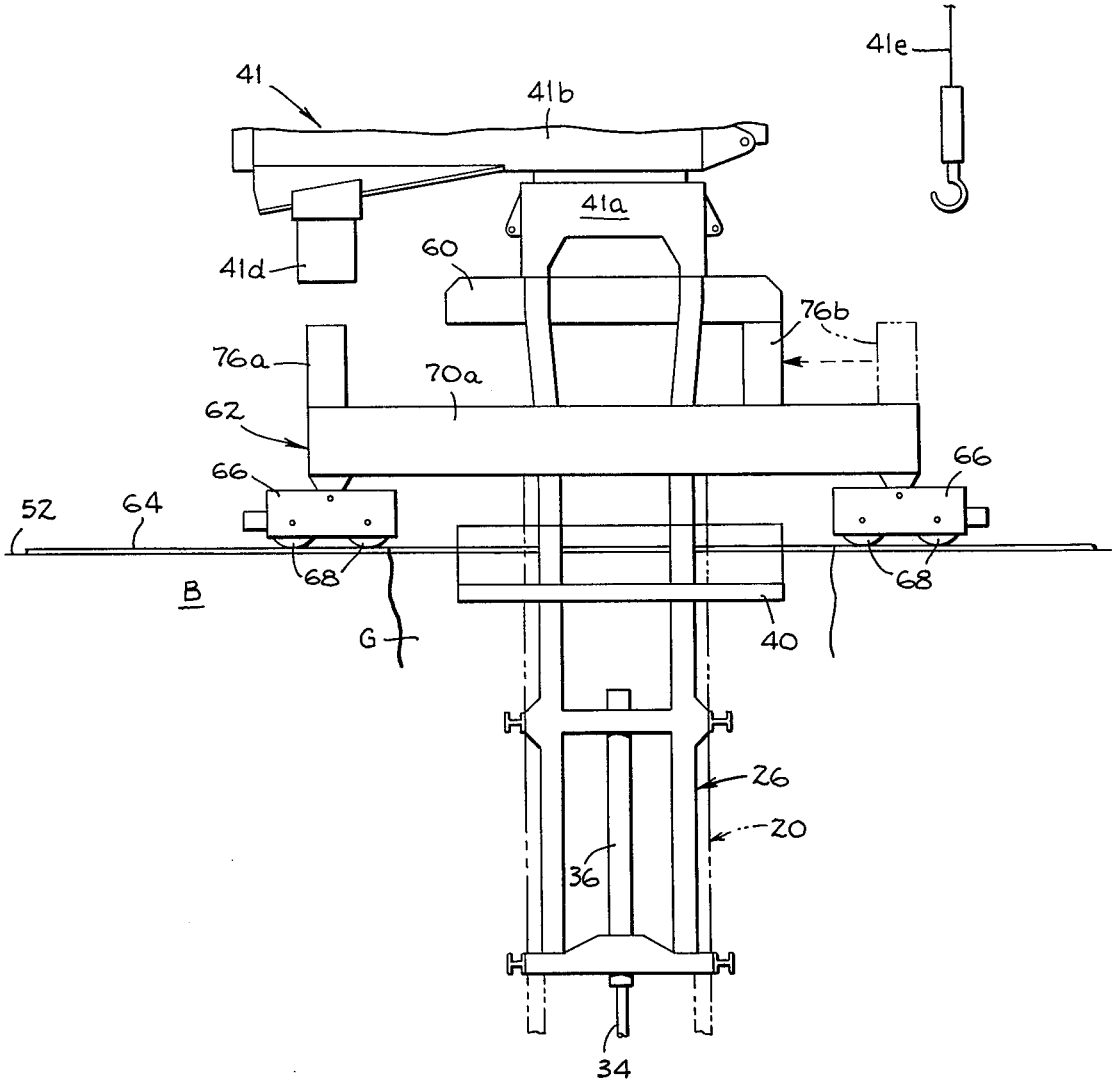
FIG. 10 shows the elevation of the crane and transition section and the centering of the bogie and shows the position of one cross beam under one end of the transition section for connection of the cross beam to the side beams of the bogie.
Figure 11:
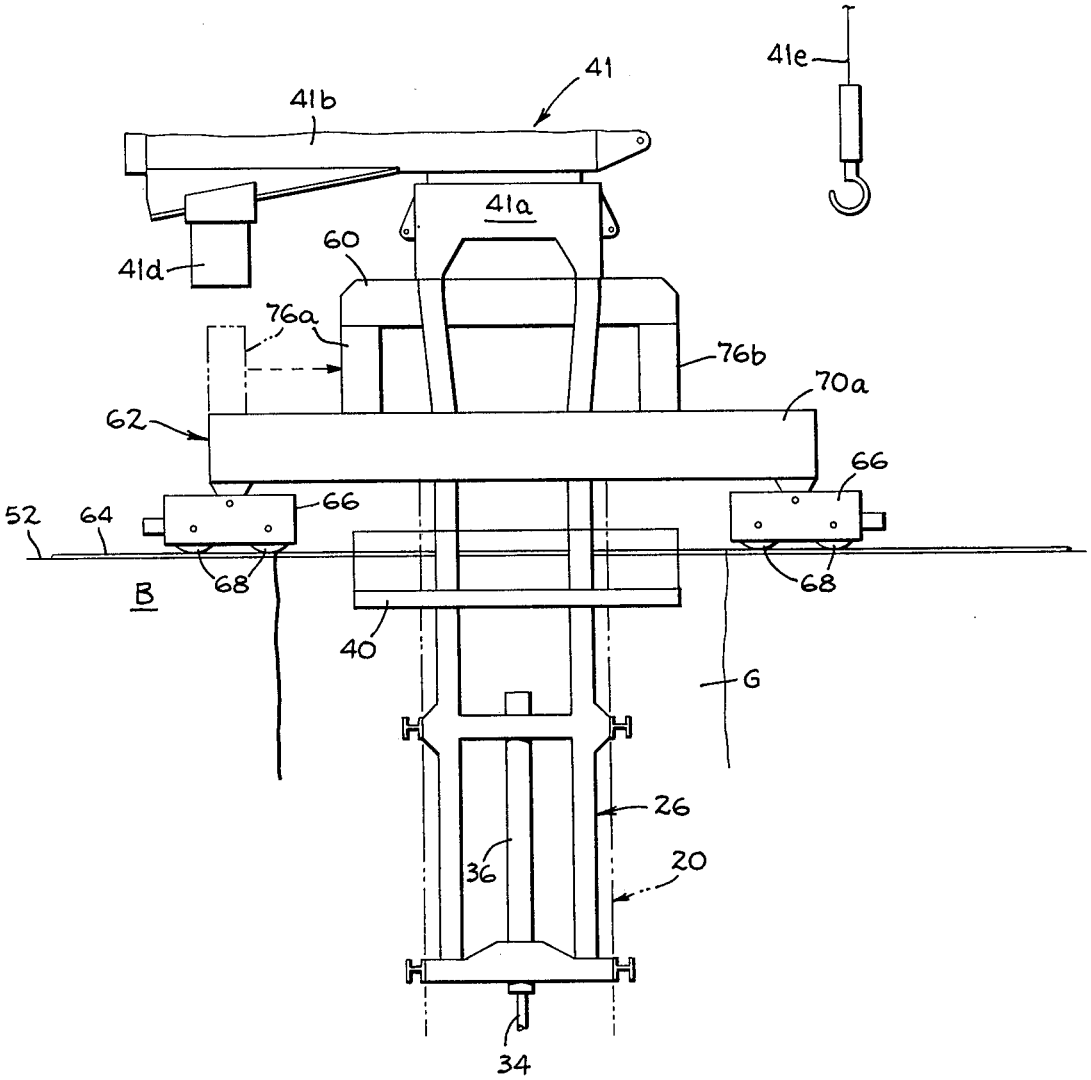
FIG. 11 shows the positioning of the other cross beam under the other end of the transition section for connection of said other cross beam to the side beams of the bogie.

The transition section 60 is unbolted from the top of the tower 20, and the climbing frame 26 is elevated to raise the crane and the transition section 60 high enough for the transition section to clear the cross beams 76*a* and 76*b*, as shown in FIG. 10. The bogie 62 is rolled to center the bogie with respect to the tower. One cross beam (say, 76*b*) is then slid under one end of the transition section and bolted to the bogie side beams 70*a*, 70*b*. The other cross beams (say, 76*a*) is then slid under the opposite end of the transition section and that cross beam is then bolted to the bogie side beams, as shown in FIG. 11.

Completion of Transfer

The crane 41 and the transition section 60 attached thereto are lowered by the climbing frame 26 onto the cross beams 76*a*, 76*b*, as shown in FIG. 12. The climbing frame is then disconnected from the crane base. Thereafter, the climbing frame is lowered below the top of the tower, as shown in FIG. 13. Cross bracing, indicated generally at 80, is installed between the two cross beams. Bracing indicated generally at 72*b* (similar to the bracing 72*a* shown in FIG. 7A) is also installed between the two bogie side beams at the open end of the bogie. Thereafter, ballast support members 82 (consisting of spaced I beams 84 connected by bracing 86) are mounted on top of the bogie side beams 70*a*, 70*b*. Ballast 88 is then raised by the crane onto the ballast support members.

It will be noted that the bogie side beams 70*a*, 70*b*, and the connecting bracing 72*a*, 72*b* defines a bogie chassis. The cross beams 76*a*, 76*b*, and the connecting bracing 80, defines bogie superstructure which is mounted on the bogie chassis and supports the transition section 60 and crane 41.

Figure 14:
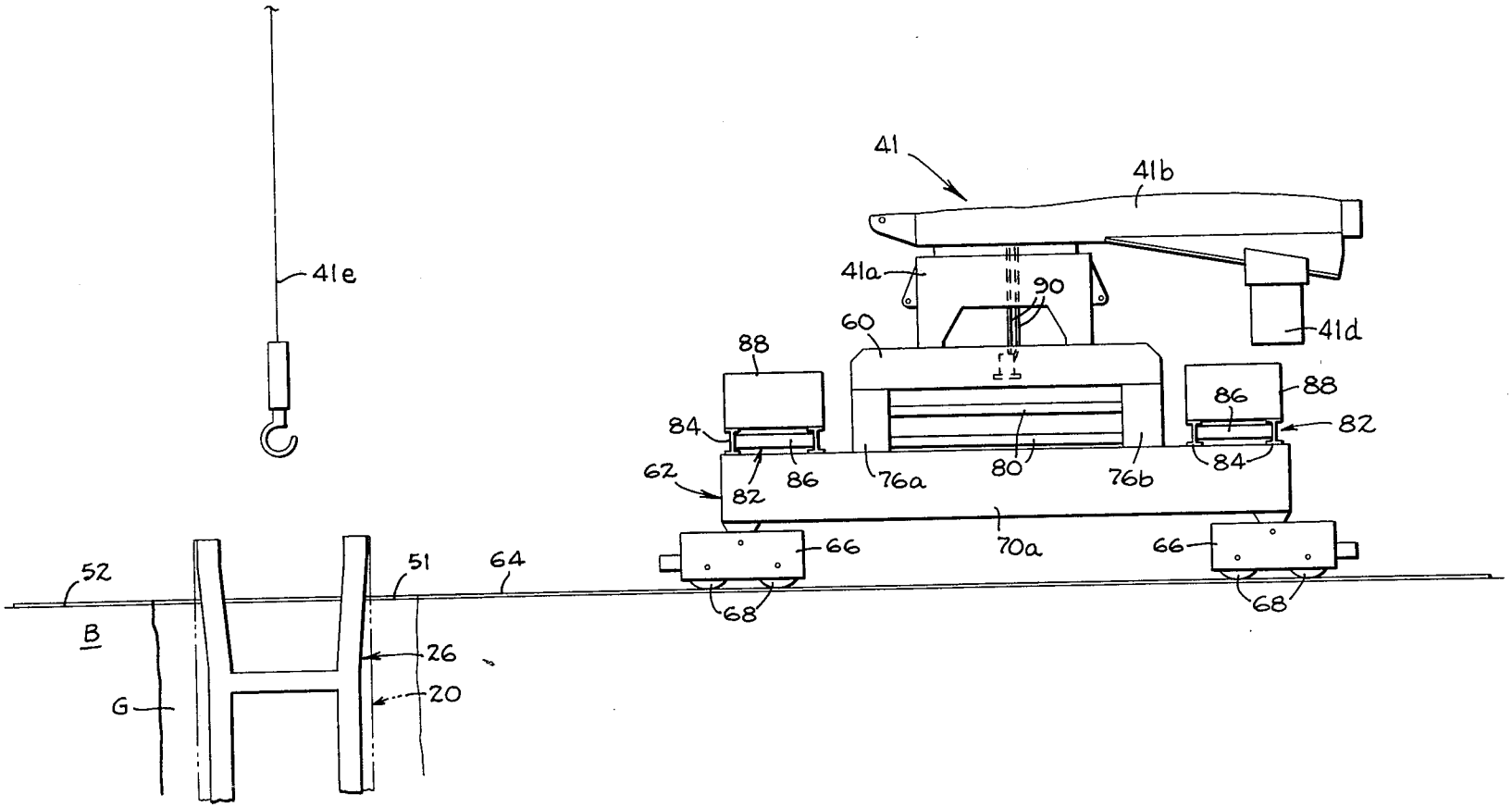
FIG. 14 shows the completion of the mounting of the crane on the bogie and the movement of the bogie away from the tower.

Thereafter, as shown in FIG. 14, hydraulic lines 90 from the crane 41 are connected to the bogie wheel motors 92 (FIG. 15) which are connected by drive chains (not shown) to the wheels. The crane, supported by the bogie, is then moved under power on rails 64 away from the tower 20.

Therefore, by the above described method, the crane can be moved around the top of the building B and used in completing the edifice. The building provides a more stable base for the crane and a wider field of operation than the tower.

Although the best mode contemplated for carrying out the present invention has been herein shown and described, it will be apparent that modification and variation may be made without departing from what is regarded to be the subject matter of the invention.

What is claimed is:

1. The method of transferring a crane from a multi-section tower formed from a plurality of interconnected sections to a site adjacent the top of the tower comprising the steps of disconnecting the crane from the uppermost section of the tower, elevating the crane above the uppermost section of the tower, assembling a structure which includes a mobile portion on the site under the elevated crane, lowering the crane onto said mobile portion of the structure, and moving the mobile portion of the structure away from the tower over the uppermost section of the tower.

2. The method of claim 1 wherein said mobile portion of said structure is lifted onto the site by operation of the crane.

3. The method of transferring a crane from the top of a multi-section tower to an elevated site adjacent the top of the tower comprising the steps of elevating the crane above the uppermost section of the tower, assembling a mobile structure on the site under the elevated crane and over the top of said uppermost section of the tower, lowering the crane onto said mobile structure for movement of the mobile structure on the elevated site away from the tower and over said uppermost tower section.

4. The method of claim 3 wherein said mobile structure is lifted from the ground onto the site by operation of the crane and is moved away from the tower by hydraulic power supplied by the crane.

5. The method of transferring a crane from the top of a multi-section tower to a building adjacent the top of the tower comprising the steps of elevating the crane above the uppermost section of the tower with an elevating mechanism on the tower for providing a gap between the top of the upper section and the crane, inserting a transition section in said gap, assembling a bogie chassis on the building under said transition section and the elevated crane and over the top of the uppermost section of said tower, assembling a superstructure on the bogie chassis in position to support the transition section and crane, lowering the crane and transition section for support on said superstructure, and moving the bogie with the crane thereon on the building away from the tower and over said uppermost tower section.

6. The method of claim 5 wherein said superstructure is lifted onto the building by operation of the crane and is assembled while on said building.

7. The method of claim 5 wherein said chassis is lifted onto the building by operation of said crane and is assembled while on said building.

8. The method of transferring a crane from a tower having an elevating frame to an elevated site adjacent to the top of the tower, said site having a bogie thereon with an open end, said bogie sufficiently wide to straddle the top of the tower, the steps comprising raising the crane above the top of the tower with the elevating frame, inserting a transition section between the crane and the top of the tower, moving the bogie open end first to straddle the elevating frame and placing cross beams on the bogie in front and behind the elevating frame, raising the crane and the transition section with the elevating frame, positioning the beams on the bogie to support the transition section thereon, and lowering the elevating frame to transfer the full support of the crane and the transition section to the beams on the bogie.

9. The method of transferring a crane from a tower having a climbing frame to an elevated site adjacent the top of the tower, said site having a bogie thereon with an open end, said bogie sufficiently wide to straddle the top of the tower, the steps comprising raising the crane above the top of the tower with the climbing frame, inserting a transition section between the crane and the top of the tower, securing the transition section to the top of the tower and the crane, moving the bogie open end first to straddle the climbing frame and placing cross beams on the bogie in front and behind the climbing frame, releasing the transition section from the top of the tower and raising the crane and the transition section with the climbing frame, positioning the cross beams on the bogie to support the transition section, securing the cross beams to the bogie and securing the transition section to the cross beams, and releasing the climbing frame from the crane and lowering the climbing frame.

10. The method of transferring a crane from a tower having a climbing frame to an elevated site adjacent the top of the tower, said site having a bogie thereon with an open end, said bogie of sufficient width to straddle the top of the tower, the steps comprising raising the crane above the top of the tower with the climbing frame, inserting with the crane a transition section between the crane and the top of the tower, securing the transition section to the top of the tower and the crane, moving the bogie open end first to straddle the climbing frame and placing cross beams on the bogie in front and behind the climbing frame, releasing the transition section from the top of the tower and raising the crane and the transition section with the climbing frame, positioning the cross beams on the bogie to support the transition section, securing the cross beams to the bogie and lowering the transition section and crane to the cross beams, and releasing the climbing frame from the crane and lowering the climbing frame.

11. The method of transferring a crane from a tower having a climbing frame to an elevated site adjacent the top of the tower, said site having a bogie thereon with an open end, said bogie of a width to straddle the top of the tower, the steps comprising raising the crane above the top of the tower with the climbing frame, inserting a transition section between the crane and the top of the tower, securing the transition section to the top of the tower and the crane, moving the bogie open end first to straddle the climbing frame and placing cross beams on the bogie in front and behind the climbing frame, releasing the transition section from the top of the tower and raising the crane and the transition section with the climbing frame, centering the bogie with respect to the tower, moving one cross beam under one end of the transition section, moving another cross beam under the other end of the transition section, securing the cross beams to the bogie, lowering the crane and transition section onto the beams, and releasing the climbing frame from the crane and lowering the climbing frame.

12. The method of transferring a crane from a tower having a climbing frame to an elevated site adjacent to the top of the tower, the steps comprising raising the crane above the top of the tower with the climbing frame, inserting a transition section between the crane and the top of the tower, securing the transition section to the top of the tower and the crane, raising parts of a bogie from the ground to the site with the crane and assembling said bogie with at least one open end, moving the bogie open end first to straddle the climbing frame and placing cross beams with the crane onto the bogie in front and behind the climbing frame, releasing the transition section from the top of the tower and raising the crane and the transition section with the climbing frame, centering the bogie with respect to the tower, moving one cross beam under one end of the transition section, moving the other cross beam under the other end of the transition section, lowering the transition section and crane onto the bogie cross beams, and releasing the climbing frame from the crane and lowering the climbing frame.

* * * * *